US010428646B2

(12) United States Patent
Zheng et al.

(10) Patent No.: US 10,428,646 B2
(45) Date of Patent: Oct. 1, 2019

(54) APPARATUS FOR DOWNHOLE NEAR-BIT WIRELESS TRANSMISSION

(71) Applicant: Institute of Geology and Geophysics, Chinese Academy of Sciences, Beijing (CN)

(72) Inventors: Jian Zheng, Beijing (CN); Wenxuan Chen, Beijing (CN); Qingyun Di, Beijing (CN); Yuntao Sun, Beijing (CN); Yongyou Yang, Beijing (CN); Wenxiu Zhang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 15/692,865

(22) Filed: Aug. 31, 2017

(65) Prior Publication Data

US 2018/0058201 A1 Mar. 1, 2018

(30) Foreign Application Priority Data

Aug. 31, 2016 (CN) ..... 2016 1 0799386

(51) Int. Cl.

| | |
|---|---|
| ***E21B 47/12*** | (2012.01) |
| ***E21B 17/02*** | (2006.01) |
| ***E21B 47/01*** | (2012.01) |

(52) U.S. Cl.

CPC ..... *E21B 47/122* (2013.01); *E21B 17/028* (2013.01); *E21B 47/011* (2013.01)

(58) Field of Classification Search

CPC ..... E21B 47/122

See application file for complete search history.

(56) References Cited

U.S. PATENT DOCUMENTS

| | | | | |
|---|---|---|---|---|
| 7,096,313 | B1 | 8/2006 | Chang et al. | |
| 7,762,854 | B1 * | 7/2010 | Peng ..... | H01R 13/508 439/578 |

(Continued)

FOREIGN PATENT DOCUMENTS

| | | | |
|---|---|---|---|
| CN | 1740746 | A | 3/2006 |
| CN | 2849164 | Y | 12/2006 |

(Continued)

*Primary Examiner* — Amine Benlagsir

(74) *Attorney, Agent, or Firm* — Novick, Kim & Lee, PLLC; Allen Xue

(57) ABSTRACT

A apparatus for downhole near-bit wireless transmission includes a bit connecting housing, a mud motor connecting housing, an insulating sub made of an insulating material. The insulating sub is serially connected between the bit connecting housing and the mud motor connecting housing to electrical insulate the bit connecting housing and the mud motor connecting housing from each other. The bit connecting housing and the mud motor connecting housing respectively form an electromagnetic transmitting positive pole and an electromagnetic transmitting negative pole. The mechanical apparatus further includes measurement units, which are configured to acquire parameters measured near the bit and a data transmitting unit, which is configured to realize wireless transmission; and the data transmitting unit is configured to receive and transmit the parameters measured near the bit.

6 Claims, 2 Drawing Sheets

(56) References Cited

U.S. PATENT DOCUMENTS

| | | | | |
|---|---|---|---|---|
| 2001/0012703 | A1 | 8/2001 | Wurm et al. | |
| 2002/0075114 | A1* | 6/2002 | Hall | E21B 17/028 336/192 |
| 2007/0247329 | A1 | 10/2007 | Petrovic et al. | |
| 2009/0023502 | A1* | 1/2009 | Koger | E21B 17/07 464/20 |
| 2009/0153355 | A1 | 6/2009 | Price et al. | |
| 2012/0249338 | A1 | 10/2012 | Merino | |
| 2012/0299743 | A1 | 11/2012 | Price et al. | |
| 2014/0090898 | A1* | 4/2014 | Moriarty | E21B 41/0085 175/78 |
| 2014/0332235 | A1* | 11/2014 | Mueller | E21B 47/011 166/378 |
| 2017/0268330 | A1* | 9/2017 | Derkacz | E21B 47/122 |

FOREIGN PATENT DOCUMENTS

| | | | |
|---|---|---|---|
| CN | 101289935 | A | 10/2008 |
| CN | 201221354 | Y | 4/2009 |
| CN | 101493008 | A | 7/2009 |
| CN | 102418516 | A | 4/2012 |
| CN | 202187758 | U | 4/2012 |
| CN | 103061755 | A | 4/2013 |
| CN | 103577121 | A | 2/2014 |
| CN | 204283400 | U | 4/2015 |
| CN | 204283413 | U | 4/2015 |
| CN | 105353357 | A | 2/2016 |
| CN | 105760113 | A | 7/2016 |
| CN | 105804722 | A | 7/2016 |
| CN | 206299372 | U | 7/2017 |
| CN | 206299375 | U | 7/2017 |

* cited by examiner

APPARATUS FOR DOWNHOLE NEAR-BIT WIRELESS TRANSMISSION

TECHNICAL FIELD

The present invention mainly belongs to the technical field of oil and gas drilling equipment, and particularly relates to apparatus for downhole near-bit wireless transmission.

BACKGROUND

In recent years, using horizontal wells to improve reservoir-encountered rate and recovery ratio of oil and gas reservoirs has been widely applied in various oil fields, and a near-bit geology-oriented drilling system can determine properties of strata in real time, exploring to-be-drilled strata in advance, implementing accurate orientation, and the like, which helps to improve discovery rate of exploratory wells, reservoir-encountered rate of development wells and recovery ratio of oil and gas fields.

A near-bit wellbore drift angle measurement instrument is usually to package a near-bit wellbore drift angle sensor at the front end of a deflection tool (downhole mud motor, e.g., a screw-type mud motor), transmit data into a conventional wireless measurement while drilling (LWD/MWD) instrument positioned at the upper part of the deflection tool (downhole mud motor) by means of a wired or wireless transmission (ultrasonic wave, electromagnetic wave, etc.), after that transmit the surface to the surface by means of a wireless transmission manner such as mud pulse telemetry or electromagnetic wave, together with the data measured by the conventional wireless measurement while drilling instrument.

Real-time acquisition of the near-bit well deflection parameter and a gamma measurement helps field drilling engineer to control the drilling trajectory of the bit and geologic parameters in drilling process, thereby improving the oil drilling and production rate. However, how to transmit parameters measured near the bit to the ground becomes the key to the development of the technology.

At present, most of domestic researches focus on transmitting the parameters measured near the bit by means of a cable embedded mud motor, an acoustic wave wireless transmission manner, a coil type electromagnetic wave wireless transmission manner, and the like.

The cable embedded mud motor belongs to a wired transmission structure: near-bit stratum information measured by a sensor within a measurement sub is transmitted to the MWD system through a cable by adopting a wired transmission manner, and a cable channel is established between the near-bit measurement sub and a receiving sub. However, these cables are embedded on each mechanical part between the measurement sub and the MWD system, and a wired channel is established, that is, there are needs for pre-burying cables in downhole drilling tools such as the measurement sub, a receiving sub and a mud motor, for a special mud motor to be suitable for signal transmission, and for solving problems of high-pressure sealing and reliable electrical connection of thread interfacing positions, resulting in low applicability.

Compared with the wired transmission manner, a wireless transmission method is lower in overall cost and better in versatility, and can be used in downhole small-data-volume transmission since there is no need for largely changing a structure of the downhole drilling tool in a manner of upwards transmitting the parameters measured near the bit.

However, in an existing wireless transmission technology, there are still the following shortcomings.

The coil type electromagnetic wave wireless transmission is as follows: electromagnetic wave transmission adopts an electromagnetic wave transmitting apparatus and an electromagnetic wave receiving apparatus. That is, coils for transmitting and receiving electromagnetic wave are respectively wound on independent drill collars, and then covered with an insulating material for protection, so that a wireless transmission apparatus is formed. Such a transmission manner requires high resistivity values of strata.

The acoustic wave wireless transmission is as follows: the acoustic wave wireless transmission manner is to respectively install a transmitting transducer and a receiving transducer at a transmitting sub and a receiving sub of the drill collar, and signals are transmitted by means of acoustic characteristics of the transmitting transducer and the receiving transducer. However, a design of the transducers makes the mechanical structure of the near-bit transmitting sub be very complicated, and long-distance wireless transmission requires larger transmission energy of the transducers, and it is difficult to realize signal reception because of the presence of a drill collar wave, resulting in difficulty in realizing wireless across-mud motor transmission of the signals.

SUMMARY

In view of the above problems, the present invention provides an apparatus for downhole near-bit wireless transmission. The mechanical apparatus for the near-bit wireless transmission is of a mechanical structure of serially connecting an insulating sub therebetween, and the insulating sub is connected with two metal subs by threads to form two poles of wireless transmission, and realizes across-mud motor wireless transmission of signals near the bit by matching with a receiving sub. By means of such a structure, the length is minimized while wireless transmission of downhole data measured near the bit is realized, and an influence of a near-bit measurement sub on the deflection of a mud motor is reduced to the minimum.

The present invention is achieved by the following technical solution:

an apparatus for downhole near-bit wireless transmission includes a bit connecting housing and a mud motor connecting housing which are both made of a metal material, and further includes an insulating sub made of an insulating material, wherein the insulating sub is serially connected between the bit connecting housing and the mud motor connecting housing to realize electrical insulation, and the bit connecting housing and the mud motor connecting housing respectively form an electromagnetic transmitting positive pole and an electromagnetic transmitting negative pole.

The mechanical apparatus further includes measurement units and a data transmitting unit, which is configured to realize wireless transmission. The data transmitting unit is configured to transmit data measured by the measurement units.

The data transmitting unit, the bit connecting housing, a stratum, a near-bit wireless transmission receiving apparatus and the mud motor connecting housing form a data transmission loop, thereby realizing across-stratum wireless transmission of the measured data.

Further, the data transmitting unit includes a metal connector, a third electrical connection line, a high-pressure sealing single-pin connector, a second electrical connection line, a transmitting circuit unit, a first electrical connection line and an electrical connection bolt which are connected in turn; the electrical connection bolt is connected with the bit connecting housing.

One end of the metal connector is connected with the surface of the mud motor connecting housing and the other end is connected with the third electrical connection line positioned inside the bit connecting housing through the insulating sub.

Further, the high-pressure sealing single-pin connector is fixed to the bit connecting housing by a stopper.

Further, the stopper is of a U-shaped groove structure, the high-pressure sealing connector is clamped in a U-shaped groove of the stopper, a spacer is installed between the stopper and the high-pressure sealing connector, and the stopper is fastened to the bit connecting housing by bolts.

Further, both ends of the insulating sub are integrally connected with the bit connecting housing and the mud motor connecting housing, respectively, by non-detachable threads.

Further, one end, having the bit connecting housing, of the mechanical apparatus is connected with bit, and one end, having the mud motor connecting housing, of the mechanical apparatus is connected with a mud motor.

Further, the mechanical apparatus further includes a battery unit, which is configured to supply a power source to the mechanical apparatus.

In summary, the mechanical apparatus of the present disclosure adopts a manner of serially connecting a high-strength insulating sub therebetween for electrical isolation. Unlike acoustic wave transmission and electromagnetic wave transmission manners, the mechanical apparatus of the present disclosure realizes wireless transmission of downhole data measured near the bit while the structure strength and the sealing property of a downhole drilling tool are not influenced.

Further, compared with acoustic wave transmission and electromagnetic wave transmission manners, a manner of serially connecting an insulating sub is simple in structure, minimizes the length of the structure, and reduces an influence of the near-bit measurement sub on the deflection of the mud motor to the minimum.

DETAILED DESCRIPTION

Objectives, technical solutions and advantages of the present invention will become more apparent from the following detailed description of the present invention when taken in conjunction with accompanying drawings. It should be understood that specific embodiments described herein are merely illustrative of the present invention and are not intended to limit the present invention.

Rather, the present invention encompasses any alternatives, modifications, equivalents, and solutions made within the spirit and scope of the present invention as defined by the claims. Further, in order to give the public a better understanding of the present invention, some specific details are described below in detail in the following detailed description of the present invention. It will be appreciated by those skilled in the art that the present invention may be understood without reference to the details.

EXAMPLE 1

Example 1 shows an apparatus for downhole near-bit wireless transmission.

Figure 1:
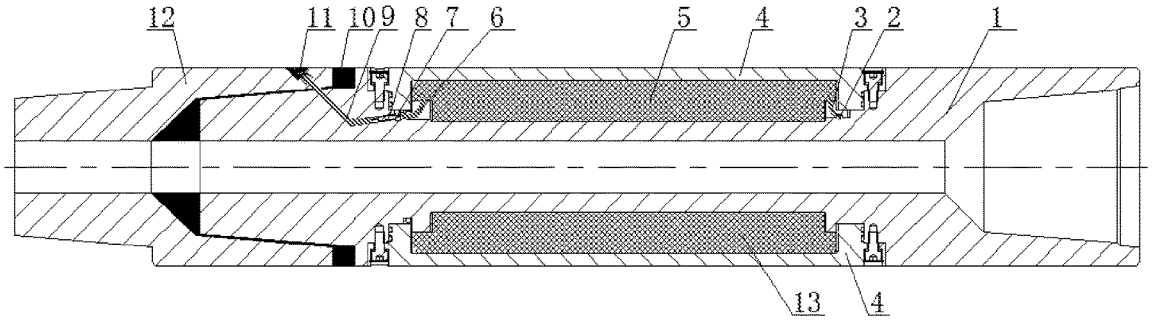
FIG. 1 is a schematic diagram of an embodiment of the mechanical apparatus for downhole near-bit wireless transmission.
Figure 2:
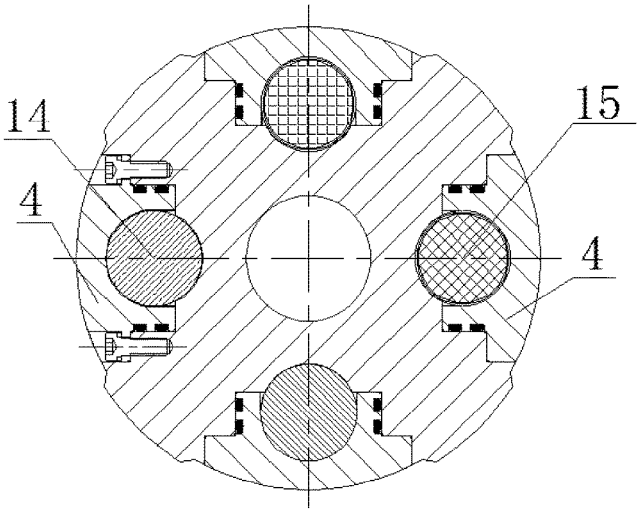
FIG. 2 is a schematic diagram of an embodiment of the interface of an apparatus for downhole near-bit wireless transmission.

As shown in FIG. 1 and FIG. 2, the mechanical apparatus includes a bit connecting housing 1 and a mud motor connecting housing 12, which are both made of a metal material. The apparatus further includes an insulating sub 10 made of an insulating material, wherein the insulating sub 10 is serially connected between the bit connecting housing 1 and the mud motor connecting housing 12 to realize electrical insulation. The bit connecting housing 1 and the mud motor connecting housing 12 respectively form an electromagnetic transmitting positive pole and an electromagnetic transmitting negative pole.

The mechanical apparatus further includes measurement units and a data transmitting unit, which is configured to realize wireless transmission. The data transmitting unit is configured to transmit data measured by the measurement units;

The measurement units include a first measurement unit 14 and a second measurement unit 15. The first measurement unit 14 is particularly a gamma measurement unit, and a gamma measurement probe is adopted to receive a stratum gamma ray to determine a gamma parameter of a stratigraphic reservoir. The second measurement unit 15 is a wellbore drift angle measurement unit, which is composed of an acceleration sensor, a magnetic sensor and a processing circuit. The second measurement unit 15 is configured to measure a near-bit wellbore drift angle, a tool face angle and an azimuth angle in drilling process. Two measurement units are located in two different compartments. Measured data of the two measurement units are transmitted to the data transmitting unit through an inclined through hole between the compartments as well as a data line; and a transmitting circuit unit 5 in the data transmitting unit is configured to transmit encoded data.

The data transmitting unit, the housing 1 connected with bit, a stratum, a near-bit wireless transmission receiving apparatus and the mud motor connecting housing 12 form a data transmission loop. During data transmission, the data transmitting unit applies a driving signal between the bit connecting housing 1 (transmitting positive pole) and the mud motor connecting housing 12 (transmitting negative pole). Since the drilling fluid and the stratum are conductive, a part of a driving current coming from the positive pole is returned to the data transmitting unit through the drilling fluid and the mud motor connecting housing 12 (this part of the signal cannot be received). The other part is received by the stratum and the near-bit wireless transmission receiving apparatus and then returned to the data transmitting unit, so as to form the data transmission loop, resulting in wireless transmission and reception of signals. The near-bit wireless transmission receiving apparatus is configured to receive an electrical signal emitted by the data transmitting unit in the mechanical apparatus for wireless transmission of the present invention.

One end of the insulating sub 10 are integrally connected to the bit connecting housing 1 while the other end connecting to the mud motor connecting housing 12 by non-detachable threads, so as to meet requirements for high torsional strength and high sealing property of a downhole drilling tool.

One end, having the bit connecting housing 1, of the mechanical apparatus is connected with bit, and the other end, having the mud motor connecting housing 12, of the mechanical apparatus is connected with a mud motor. A box is disposed at the end of the bit connecting housing 1. A pin is disposed at the end of the mud motor connecting housing 12.

The data transmitting unit is configured to transmit parameter data measured near the bit. The data transmitting unit includes a metal connector 11, a third electrical connection line 9, a high-pressure sealing single-pin connector 8, a second electrical connection line 6, a transmitting circuit unit 5, a first electrical connection line 3 and an electrical connection bolt 2 which are connected in turn. The electrical connection bolt 2 is connected with the bit connecting housing 1.

One end of the metal connector 11 is connected to the surface of the mud motor connecting housing 12 and the other end is connected to the third electrical connection line 9 positioned inside the bit connecting housing 1 through the insulating sub 10, wherein the metal connector 11 is connected to the mud motor connecting housing 12 in a welding manner.

The high-pressure sealing single-pin connector 8 is fixed to the bit connecting housing 1 by a stopper 7.

Figure 3:
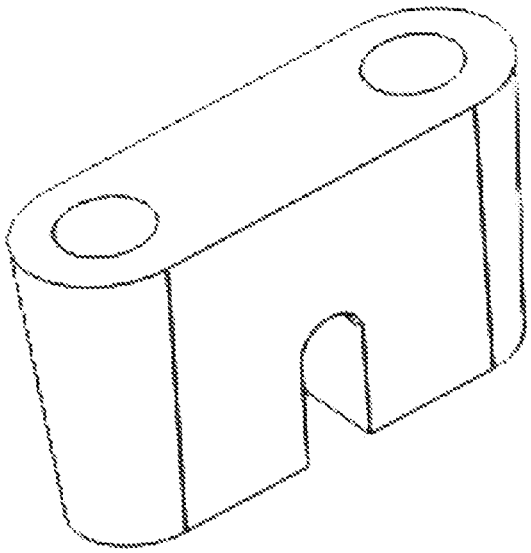
FIG. 3 is a schematic structural diagram of a stopper.
Figure 4:
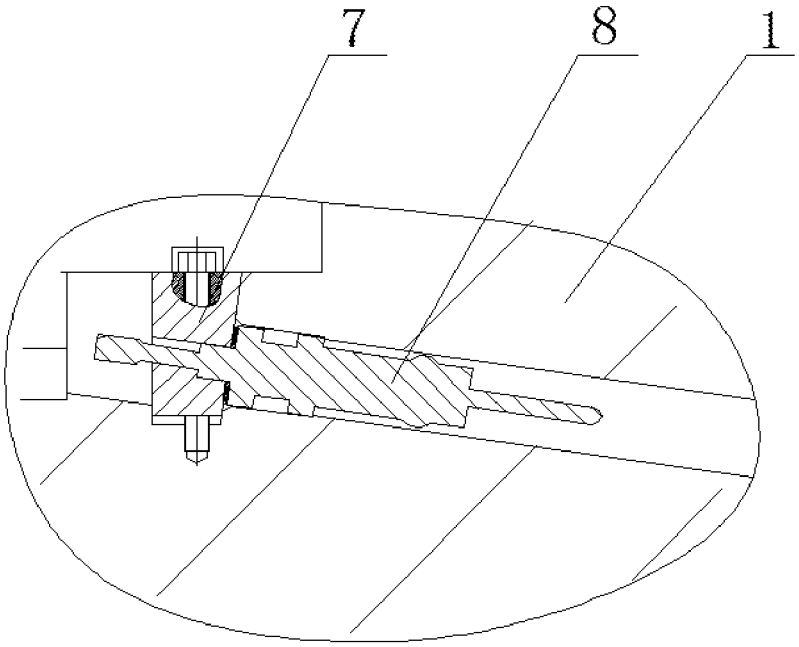
FIG. 4 is a schematic assembly diagram of a stopper; and reference numbers: 1. bit connecting housing; 2. electrical connection bolt; 3. first electrical connection line; 4. sealing cover plate; 5. transmitting circuit unit; 6. second electrical connection line; 7. stopper; 8. high-pressure sealing single-pin connector; 9. third electrical connection line; 10. insulating sub; 11. metal connector; 12. mud motor connecting housing; 13. battery unit; 14. first measurement unit; 15. second measurement unit.

As shown in FIG. 3 and FIG. 4, the stopper 7 is of a U-shaped groove structure. A high-pressure sealing connector 8 is clamped in a U-shaped groove of the stopper 7. A spacer is installed between the stopper 7 and the high-pressure sealing connector 8. When the stopper 7 is installed on the bit connecting housing, pre-tightening force of the stopper 7 is realized by means of connection of the bolts, the stopper 7 and an inclined plane of the bit connecting housing 1. The spacer is installed between the stopper 7 and the high-pressure sealing connector 8 so that pre-tightening the high-pressure sealing single-pin connector is realized while pre-tightening the stopper 7 is achieved.

In addition, the mechanical apparatus further includes a battery unit 13, which is configured to supply power to the mechanical apparatus.

The bit connecting housing 1 of the mechanical apparatus includes four compartments inside, wherein the four compartments are internally configured to install the transmitting circuit unit 5, the battery unit 13, the first measurement unit 14 and the second measurement unit 15, respectively. The four compartments are sealed by a sealing cover plate 4. A through hole is provided in the compartment which is configured to install the battery unit, which is configured to supply power to units in other compartments.

The invention claimed is:

1. An apparatus for downhole near-bit wireless transmission, comprising:

a bit connecting housing;

a mud motor connecting housing;

an insulating sub made of an insulating material, wherein the insulating sub is serially disposed between and electrically insulates the bit connecting housing from the mud motor connecting housing, and the bit connecting housing and the mud motor connecting housing form an electromagnetic transmitting positive pole and an electromagnetic transmitting negative pole, respectively; and one or more measurement sensors and a data transmitting circuit, wherein the data transmitting circuit comprises a metal connector disposed about a surface of the mud motor connecting housing;

an electrical connection line extending from the mud motor connecting housing to the bit connecting housing through the insulating sub, and a high-pressure sealing single-pin connector coupled to the metal connector via the electrical connection line, wherein the high-pressure sealing single-pin connector is affixed to the bit connecting housing via a stopper, and the stopper is of a U shape having a groove and the high-pressure sealing connector is clamped in the groove in the stopper, a spacer is installed between the stopper and the high-pressure sealing connector, and the stopper is fastened to the bit connecting housing.

2. The apparatus for downhole near-bit wireless transmission according to claim 1, wherein the data transmitting circuit further comprises a signal transmitting circuit disposed about the bit connecting housing that is connected to the high pressure sealing single-pin connector.

3. The apparatus for downhole near-bit wireless transmission according to claim 1, wherein the insulating sub is integrally connected with the bit connecting housing and the mud motor connecting housing through non-detachable threads.

4. The apparatus for downhole near-bit wireless transmission according to claim 1, wherein the bit connecting housing is connected with a drill bit, and the mud motor connecting housing is connected with a mud motor.

5. The apparatus for downhole near-bit wireless transmission according to claim 1, further comprising a battery disposed about the bit connecting housing.

6. The apparatus for downhole near-bit wireless transmission according to claim 1, wherein the one or more measurement sensors are a gamma ray measurement sensor and/or a wellbore drift angle measurement sensor.

* * * * *